US005857472A

United States Patent [19]

Steinhardt et al.

[11] Patent Number: 5,857,472

[45] Date of Patent: Jan. 12, 1999

[54] DEVICE FOR RINSING A FLUID-STORAGE SPACE

[76] Inventors: Lothar Steinhardt, Kehlweg 19, D-65239 Hochheim; Jörg-Michael Steinhardt, Kantstrasse 18, D-65232 Taunusstein, both of Germany

[21] Appl. No.: 711,933

[22] Filed: Sep. 11, 1996

[30] Foreign Application Priority Data

Sep. 12, 1995 [DE] Germany ..... 195 33 483.3

[51] Int. Cl.[6] ..... B08B 9/08

[52] U.S. Cl. ..... 134/56 R; 134/166 R; 134/104.1; 134/201; 137/397

[58] Field of Search ..... 134/166 R, 167 R, 134/166 C, 104.1, 201, 56 R, 57 R, 58 R; 210/163; 137/240, 397

[56] References Cited

U.S. PATENT DOCUMENTS

| | | | |
|---|---|---|---|
| 1,722,471 | 7/1929 | Katona | 137/397 |
| 3,661,261 | 5/1972 | Lemke . | |
| 4,225,434 | 9/1980 | Ernst et al. | 137/397 |
| 4,441,517 | 4/1984 | Phillips | 134/166 R |
| 4,800,907 | 1/1989 | Giehl et al. | 137/397 |
| 5,078,799 | 1/1992 | Matter et al. | 134/167 R |
| 5,086,795 | 2/1992 | Harms | 134/166 R |

FOREIGN PATENT DOCUMENTS

| | | | |
|---|---|---|---|
| 509293 | 5/1976 | U.S.S.R. | 134/166 R |
| 2213899 | 8/1989 | United Kingdom | 134/104.1 |
| WO93/18864 | 9/1993 | WIPO . | |

*Primary Examiner*—Frankie L. Stinson
*Attorney, Agent, or Firm*—Max Fogiel

[57] ABSTRACT

The invention concerns a device for rinsing a fluid-storage space that is provided with a rising chamber fillable with a fluid arranged in the region of the high point of the storage-space floor, which chamber, when the storage space runs empty, abruptly lets the fluid run out through a rinse opening as a rinsing torrent. The rinsing device has a container that serves to hold the rinse fluid; the container is either raisable, so that rinse fluid floods out through its bottom opening, or else the upper edge of the container is lowerable, so that the rinse fluid, coming forth from here, can flood out radially.

24 Claims, 11 Drawing Sheets

DEVICE FOR RINSING A FLUID-STORAGE SPACE

BACKGROUND OF THE INVENTION

The invention concerns a device for rinsing a fluid-storage space, which is provided with a rinsing chamber, fillable with a fluid, arranged in the region of the high point of the floor of the storage space, which rinsing chamber when the storage space runs empty, abruptly lets the fluid flow out through a rinse opening as a rinsing flood.

From EP 0 211 b1 is known a fluid storage space, in particular a rain basin or a canal reservoir, with a rinsing chamber, fillable with storage fluid, arranged in the region of a high point of the floor of the storage apace, which an the storage apace empties abruptly lets the storage fluid flow out as a rinsing flood through a rinse opening toward the drain of the storage space. The rinsing flood is released from the rinsing chamber by abruptly opening a flap pivoted above, which is controlled by the fluid level in the storage space. From this document is also known a circular storage space, in which rinse chambers are arranged radially on the outside, which are provided with cover doors and are flushed toward the middle of the storage space.

From CH 590 990 is known a tilting rinsing device arranged above the floor that is filled with water from above, and by change of location of its center of gravity tilts when filled, whereby the fluid gathered in the tilting rinsing device exits as a rinsing flood.

From DE-AS 23 02 583 is known a rinsing device arranged centrally in a circular storage space, which device rinses toward the outside. The rinsing device is designed as a rotating water wheel or as a pump for boosting and distributing the rinsing fluid.

SUMMARY OF THE INVENTION

In view of this background, it in the object of the present invention to declare other device configurations for rinsing a fluid storage space.

A first configuration according to the invention of the rinsing device mentioned at the beginning provides that the rinsing chamber shows a container open on the floor that is raisable and lowerable as a whole, or, as a minimum, a lower container section of the container that is raisable and lowerable, where in its sunken position the container in closed off by the floor of the storage space and in its raised position, as a minimum, is partly raised from the storage space floor. Thus the fluid serving as a rinse is collected in the container, and with the lifting of the container or of the lower container section an opening is formed between its lower edge and the storage space floor, through which opening the ringing fluid can exit from the container. In the sense of a rinsing flood, one should strive to have the container lifted abruptly for rinsing.

A second configuration according to the invention of the rinsing device mentioned at the beginning provides that the rinsing chamber is a container with a container floor lying on the storage space floor and a container wall seated in the container floor, where the container wall is raisable and lowerable as a whole or at least a lower section of the container wall is raisable and lowerable. so that the container wall or its lower section is closed off in its lowered position by the container floor and in the raised position is at least partially raised from the container floor. While with the previously mentioned first configuration according to the invention, the storage space floor to all purposes represents the container floor, and closes this off below when the container is lowered, in the second configuration of the rinsing device according to the invention a separate container floor is provided for that rents on the storage space floor or is connected with this. The advantage of this configuration in to be seen in the fact that the rinsing device can be prepared as a complete unit, and for operation of the rinsing device it is only necessary to place this in the storage chamber, or to connect its container floor with the storage space floor, so that the rinsing device is arranged spatially fixed in the storage space.

A third configuration according to the invention of tho rinsing device mentioned at the beginning provides that the rinse chamber has an opentop container that is open below and is closed off by means of the storage space floor or in closed below, the whole container or at least an upper container section in the region of at least a part of the upper edge of the upper container or in the region of a part of the upper edge of the upper container section being lowerable and raisable. Thus with this configuration the outflow of the rinsing fluid results not from the opening formed between the container and the storage space floor or between the container wall and the container floor, but rather after the filling of the container with fluid the container or the upper section of the container in the region of at least a part of its upper edge is lowered, whereby the rinsing fluid can stream away radially over the container or, through the use of several straight segments, in essence radially.

On basis of theme fundamental configurations of the rinsing device, very different further configurations are conceivable:

An arrangement for filling the container can be conceived in the most various ways. Thus it is conceivable, proceeding from the fundamental principle, to fill the container with storage fluid. On the other hand it is conceivable to introduce rinsing fluid from the outside. Especially if storage fluid it to be introduced to the rinsing chamber, it can be considered advantageous if the device for filling the container is designed as a check flap valve integrated into the container or as a booster pump that also pumps water from a dry weather reservoir or groundwater or industrial water into the container. In principle it is conceivable to bring in the rinsing fluid from a common supply conduit that is arranged above the container, so that the fluid gets into the container due to the normal flow drop The variant with the integrated check valve has the advantage that it fills the container by, itself in accordance with the inflow level of the storage liquid of the storage chamber, which obviously is also possible to do with a pump that detects by means of sensors a certain fluid level and is switched on. Finally, it is conceivable to fill the rinsing container from the exit opening itself, and to close it only at a certain water level that corresponds to the maximum fill level of the rinse container. Further, filling can take place over an overflow edge, for example, by means of an integrated submersible wall that, if necessary, is floating.

The lifting motion of the container or of the container section or of the container wall results appropriately from the use of a float.

It is also conceivable to raise and/or lower the container, the container section or the container wall with a motor, with or without a counterweight. A ballast tank can also be provided for that is fillable with fluid, especially storage fluid The lifting motion of the filled ballast tank is advantageously achieved in this way; with the storage space having run empty or to a great extent having run empty, the fluid in the ballast tank can empty out through a conduit connected to the ballast tank and the decrease in the weight of the ballast tank along with the rinse fluid located in the container leads to a lifting of the ballast tank through hydraulic pressure surface or by means of the assistance of a spring.

As far an is required, a device should be planned for making fast, in particular for latching the container, the container section or the container wall in its lowered or raised position. This device is appropriately controlled through the level of the storage fluid in the storage space. With an inflow of fluid into the storage space the latching means are activated, and with the emptying of the storage space are again released. The control means can be achieved for example through a float in the region of the storage space outlet or through sensor means, which determine the fluid level in the storage space, and either directly or through positioning means, for example, electrical, hydraulic or pneumatic motors, which operate the parts of the structure effecting the latching.

The configuration of the rinsing device according to the invention is not limited hereto, that the container, the container section or the container wall is movable perpendicular to the floor. This will indeed be the rule, but it is likewise possible that the container, the container section or the container wall is located on the floor of the storage space in such a manner as to be tiltable. In this case the container, the container section or the container wall is only partly lifted from the storage space floor or from the container floor, so that a directed stream of fluid takes place at the escaping from the container, to the effect that this occurs in all directions except for the direction cut off by the resting of the container, the container section or the container wall on the storage space floor or the container floor It is especially conceivable in the case of the tippable positioning of the container, the container section or the container wall to further plan one or several shutters that at the raising or lowering of the container, the container section or the container wall, cover the opening formed toward the side between the container edge and the storage space floor. Here also there results a directed stream, since the shutter prevents an outstreaming of the rinsing fluid in the shutter region of the container. The shutter in question is preferably attached to the storage space floor, but it can also be positioned in the container in such a manner that it can pivot.

The container, the container section or the container wall in as a rule constructed to be rigid. However, it is likewise conceivable to form these parts so that they are flexible, in particular in the style of a bellows. The height of the container can then be shortened to a relatively small size, whereby with a stationary lower container section or a stationary upper container section it is possible to lower the upper container edge or to raise the lower container edge almost completely to the stationary region of the container. Through the large opening so formed, the fluid can be let out into the storage space in the shortest time.

From a construction viewpoint the rinsing device is designed so that the container or the container wall is seated on one or several bearing elements which can be raised or lowered and are connected to the storage space floor. The container walls can, for example, be provided with bearing bushings where each bearing bushing is seated on a raisable or lowerable bearing element in the form of a pole. It is also conceivable to connect the container or the container wall with cross pieces running radially inward, which are provided with a bearing bushing(s) that is(are) raisable or lowerable as a single bearing element in the form of a pole.

The rinsing device described above is best suited for rinsing in a round basin. It can, however, be installed in any other kind of basin. Beyond the rinsing of a rain basin, installation in considered at a canal reservoir or a canal, especially the installation of the container in the region of a canal shaft. The form of the container that is in particular seated in bearing elements that are connected to the storage space floor, makes it possible to install the rinsing device later without great cost. Easy subsequent installation is especially possible if the container constitutes a unit, with a container floor and with a wall designed as a hollow cylinder seated, on the floor so that the container floor has only to be attached to the floor of the storage space. With round basing, after each filling the rinsing device allows cleaning of the round basin of the deposited muck. This cleaning is accomplished in particular with retained water. Preferably, the activation or operation of the rinsing device occurs without external energy. Nevertheless as an option, motor drive in possible, especially with an electro-hydraulic arrangement. The construction is simple and robust, and its production cost is minimal given its extremely long life The device is able to function even when the mechanical parts are extremely contaminated. It is simple to assemble. It requires no attachment components to be built at the building site, but rather with the appropriate configuration of the structure it can be installed on the floor. A subsequent fitting to, for example, a rectangular basin is thus possible.

BRIEF DESCRIPTION OF THE DRAWINGS

The invention is represented in the figures with the aid of different implementation forms, without being limited to them.

Shown in schematic representation are:

FIGS. 5*a* and 6*b* A modified implementation form of the rinsing device in different operating states, FIG. 7*a* and 7*b* A further implementation form of the rinsing device with tippable container, in different operating states.

DESCRIPTION OF THE PREFERRED EMBODIMENTS

Figure 1A:
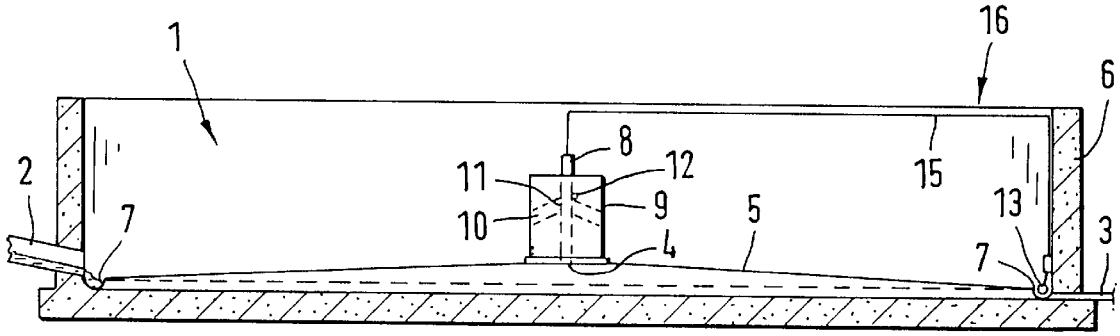
FIGS. 1*a* to 1*d* A fluid storage space with rinsing device in different operating states of the rinsing device.

FIGS. 1*a* to 1*d* show a fluid storage space 1 that is designed as a round basin, with an inlet 2 to the fluid storage space 1 and an opposite-positioned outlet 3 of the fluid storage space 1 The high point 4 of the basin floor 5 of the fluid storage space 1 is located in the middle of the round basin. Along the outer wall 6 of the round basin runs a rinsing sump with a dry weather guttor 7. In the middle of the basin, i.e., in the region of the high point 4 of the floor, is a vertical pole 8 connected to the basin floor 5, the pole bearing a container 9 that is open above and below, i.e., is designed as a circular ring wall. on the inside the container has bearing supports 10, that are connected to a bearing bushing 11 leading to the pole 8. A latching element 12, whose specific construction will be described later. is located on pole 8 and, with the container lowered, grasps from behind the bearing bushing 11, as is shown in FIGS. 1*a* to 1*e*. A controlling float 13 located in the region of the outlet 3 and of the rinsing sump with dry weather gutter 7 controls the latching element 12 via a hydraulic arrangement 14 along with hydraulic conduit 15.

Figure 1B:
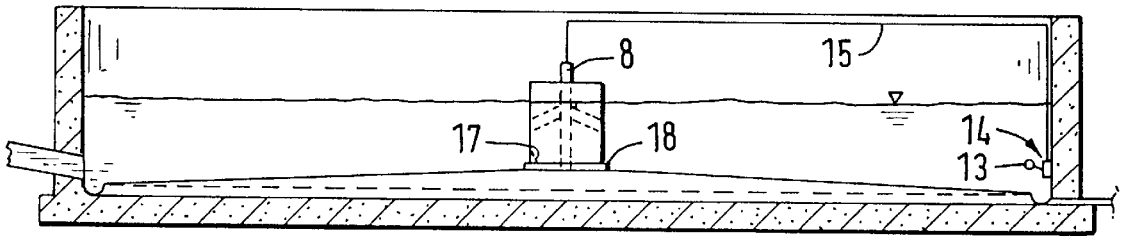
Figure 1C:
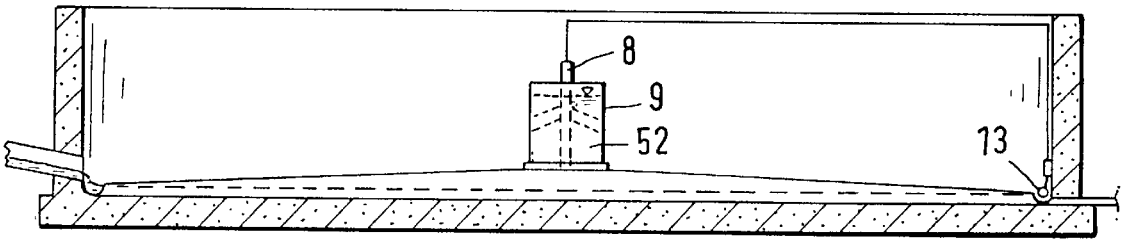
Figure 1D:
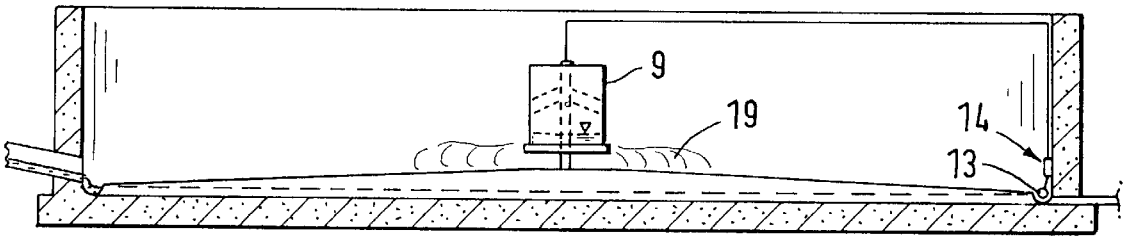

FIG. 1*a* shows the condition in dry weather. In dry weather the accumulating water runs through the basin 16 along the rinsing sump with dry weather gutter 7. For better recognition this is represented as a dashed line in the drawings of FIGS. 1*a* to 1*d* in the region of inlet 2 and outlet 3 and of the rinsing sump with dry weather gutter 7. As is to be inferred from the representation of FIG. 1*a*, the container 9 rests with its lower edge an the basin floor 5 and the controlling float 13 in lowered. With a slight accumulation of fluid in the fluid storage space 1, i.e., before the fluid gets up to the region of the container 9, the controlling float 13 is slightly lifted and it activates latching element 12. which consequently holds the container 5 firmly in this position. With a further accumulation of water as shown in FIG. 1*b*, storage fluid flows through a check valve 17 in the lower region of the container 9 and flows into it, whereby the storage fluid in the storage fluid space and the rinse fluid in the container 9 adjust themselves to the same fluid level. The controlling float 13 is lifted further and is flooded over. If the fluid state in the storage space again sinks, for example after a rain event, the fluid storage space 1 empties, and the fluid in the container 9 is retained, since the container was held back during the rise by the latching element 12. FIG. 1*c* shows the conditions in nearly dry weather and with the again lowered controlling float 13. If the controlling float 13 is in its lowered position, it controls the latching element 12 by means of the hydraulic arrangement 14, by which this element is shifted into its unlatched position, and the container 9 is abruptly raised up. This occurs because the container displays at its lower region a steplike extended flat section 18, from which an upward force component results that raises the container 9. The result is that the contents of the container 9 abruptly gush out radially as a rinsing torrent toward the surrounding container wall 6. Finally the container 9 sinks again and with a new inflow of fluid it is latched in the fluid storage space 1.

Figure 2A:
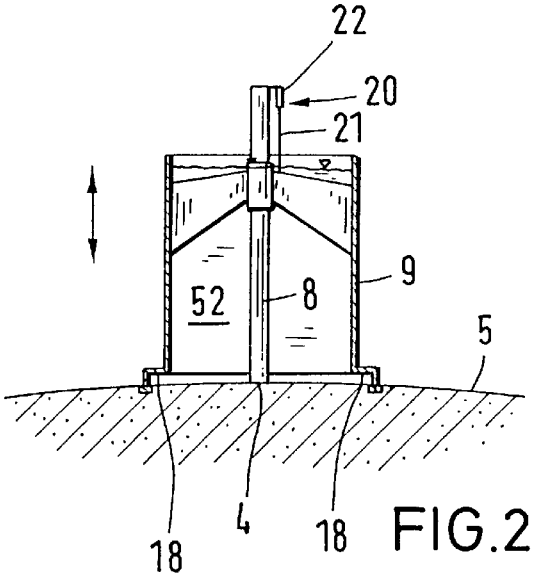
FIGS. 2*a* and 2*b* A rinsing device equipped with damping elements with a raisable container in different operating states.
Figure 2B:
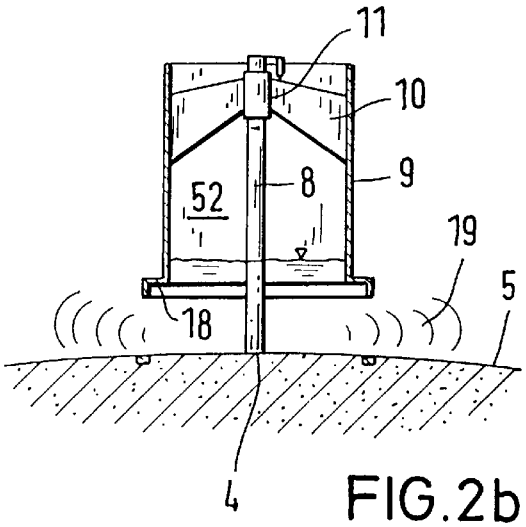
Figure 2C:
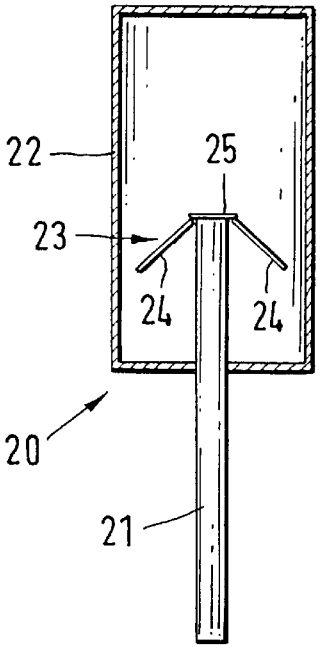
FIGS. 2*c* and 2*d* Detailed representation of the damping elements in different operating states.
Figure 2D:
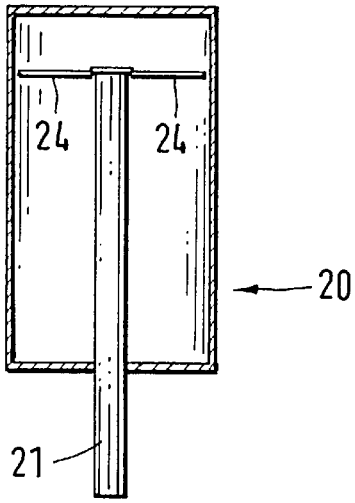
Figure 3:
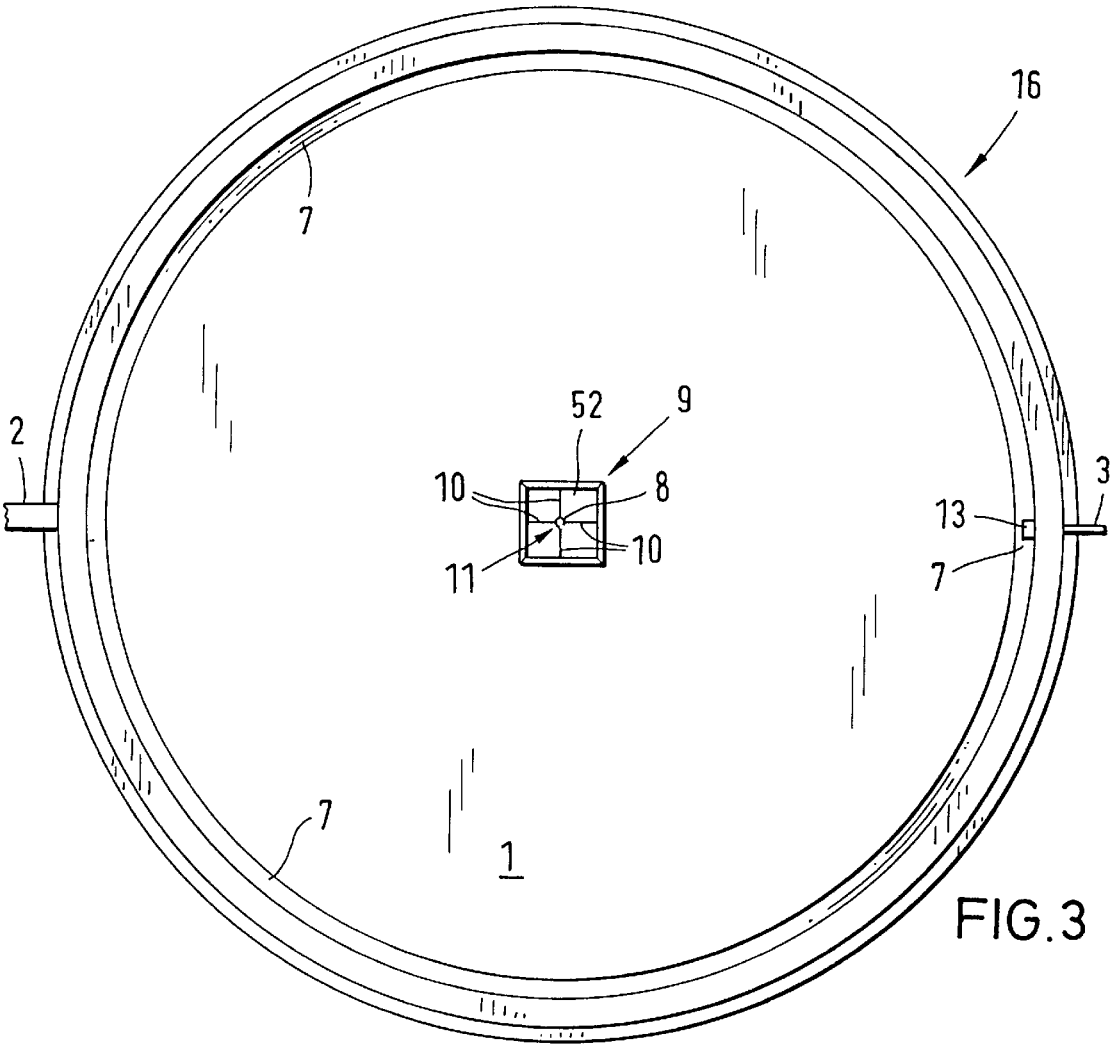
FIG. 3 A plan view of a round basin fitted with a rinsing device.

FIGS. 2*a* to 2*d* show a variant in which a damping element 20 is provided for, that hinders the abrupt sinking of the container 9 from its maximum raised position, so that the outflow of the contents of the container can occur at the optimal rinsing flood. FIG. 2*a* shows the filled container 9 shortly before emptying. The damping element 20 is attached between the upper end of the pole 8 and one of the bearing supports 10. FIG. 2*b* shows the raised container 9 and the rinsing flood 19 released form it. The construction of the damping element 20 is illustrated in detail in FIGS. 2*c* and 2*d*. A piston shaft 21 connected to the bearing support 10 passes through an opening in the cylinder 22 connected with the upper end of the pole 8. The piston 23 arranged in the cylinder 22 is formed as two wings, where the two wings 24 are pivoted at the upper end of the piston shaft 21 and are swingable in the direction of the piston shaft 21, A plate 25 arranged in the region of the end of the piston shaft 21 represents a stop for the wings 24. This design 1*a* conditioned on the fact that with the raising of the container 5 the wings fold up, and the damping element 20 does not function. while with the lowering of the container 9 the wings 24 swing into their tended position whereby the container 9 can only sink slowly since only a low-volume stream can flow between the free ends of the wings 24 and the cylinder wall. In principle any kind of damping elements are possible, for example, shock absorbers, springs FIG. 3 shows a plan view of the round basin 16. The implementation form represented there is supposed to illustrate in particular that the container 9 can show any cross-section whatever, for example rectangular.

Figure 4:
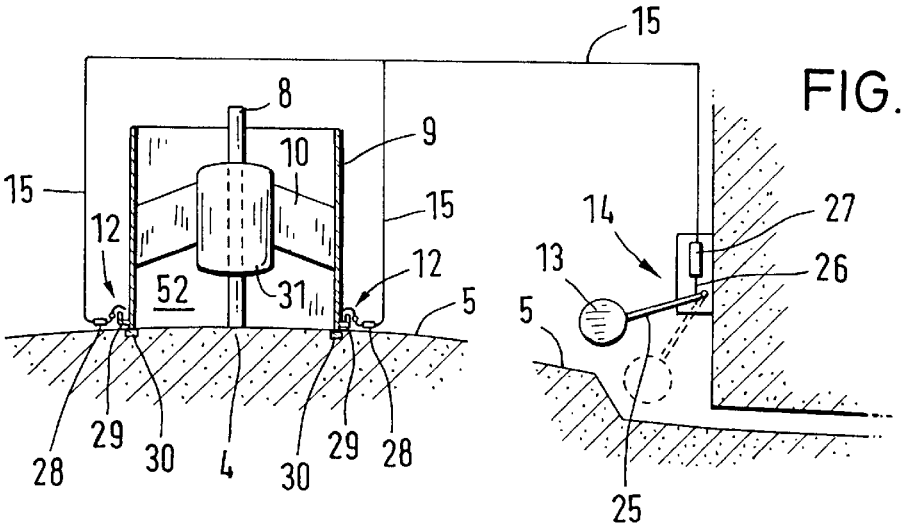
FIG. 4 A rinsing device with a hydraulic system working in Conjunction with it for activating the rinsing device.

FIG. 4 illustrates the hydraulic arrangement 14 in the fluid storage space 1 in an enlarged representation depicting only the edge and the middle. There the motion of the controlling float 13 is transferred via its float arm 25, shown in two positions, to a piston shaft 26 of a hydraulic cylinder 27, by which, by way of the hydraulic conduit 15, the hook-form latching elements 12 connected to the floor of the basin 5 are opened, to which elements the hydraulic cylinder 28 are assigned. The hook-form latching elements 12 in their latching position grasp from behind hook-form upward-oriented extensions 29 that are arranged in the lower region of the container 9, At the basin floor 5 in the region in contact with the lower edge of the container 9 iron plate 30 or similar are introduced to form a flat surface intended for the dealing components. In this variant, in contrast to the implementation form according to FIGS. 2*a* and 2*b*, the container is not provided with pressed-out buoyancy-generating sections 19, but instead of this a float 31 surrounding the bearing bushing 11 is attached to the bearing bushing 11 placed on the bearing support 10, which float produces the bouyancy of the container 9. In principle, a pneumatic control can likewise be used in place of a hydraulic control.

Figure 5A:
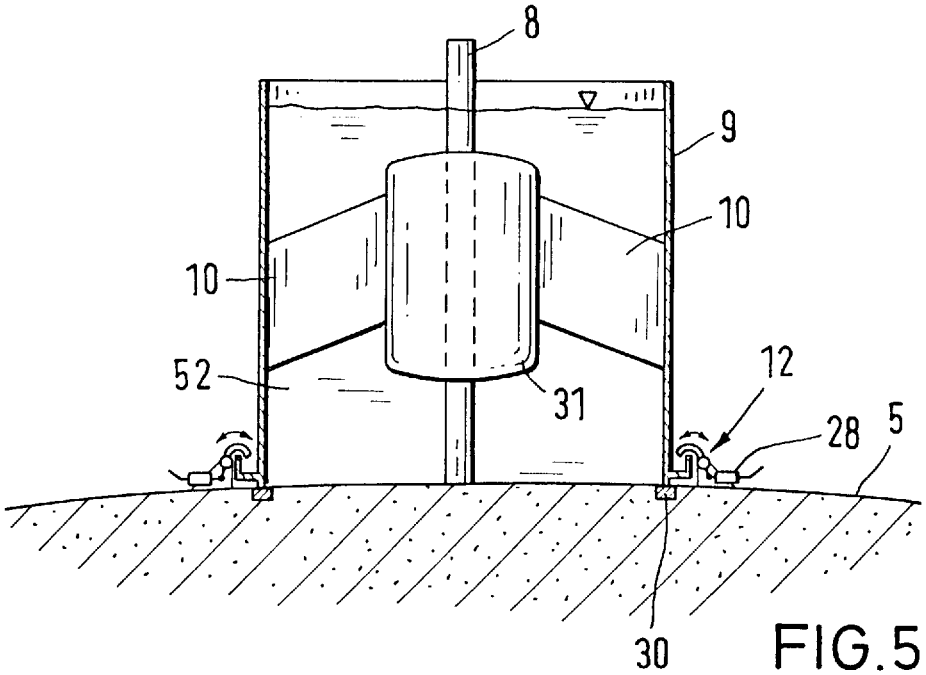
FIGS. 5*a* and 5*b* The variant of the rinsing device illustrated in FIG. 4 in enlarged representation, in different operating states.
Figure 5B:
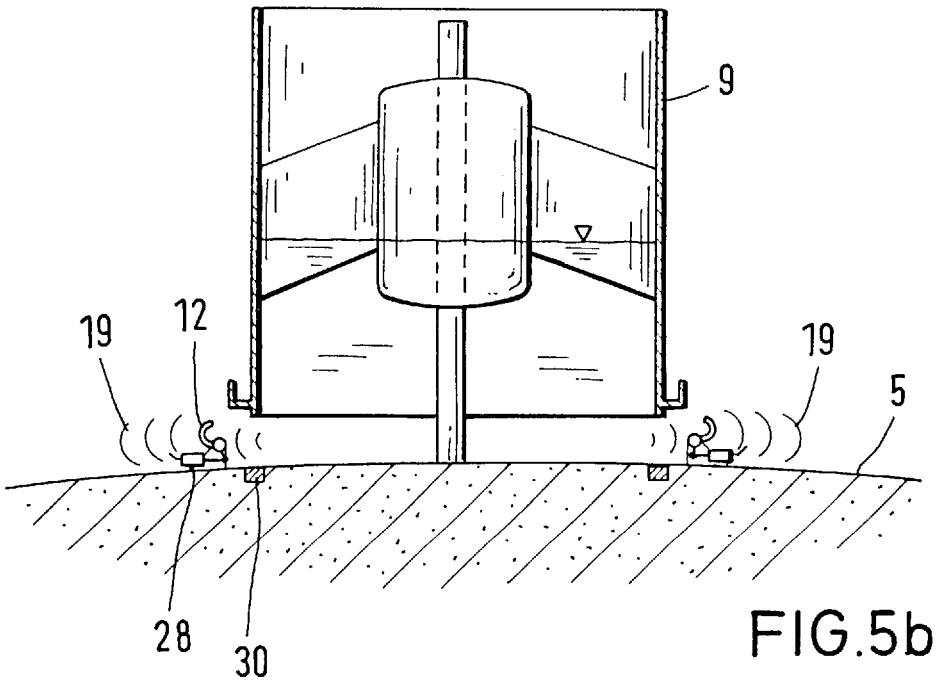

FIGS. 5*a* and 5*b* show the container depicted in FIG. 4 in an enlarged representation and for two operational states. FIG. 5*a* illustrates the filled container 5 with latching elements 12 positioned in the latched position. FIG. 5*b* illustrates the latching elements 12 in their un-latched position and the container 9 raised by means of the float 31, with the rinsing flood 19 coming forth from this container. In the representation in the preceding figures and likewise in the following figures, the marking in of the means for the filling of the container 9 is mostly dispensed with. In the explanation of the representation in FIGS. 1*a* through 1*d*, it was already pointed out that this filling can take place in each case via a checking shutter 17 located in the lower region of the container 9 which will yet be explained in detail below. The filling can also come about through the fact that upon the accumulation of fluid in the fluid-storage space 1 the container 9 is flooded over, so that the stored fluid enters this container 9 through its open top side. It is also conceivable to fill the container from above by means of a supply conduit, as far as possible in a free fluidfall.

Figure 6A:
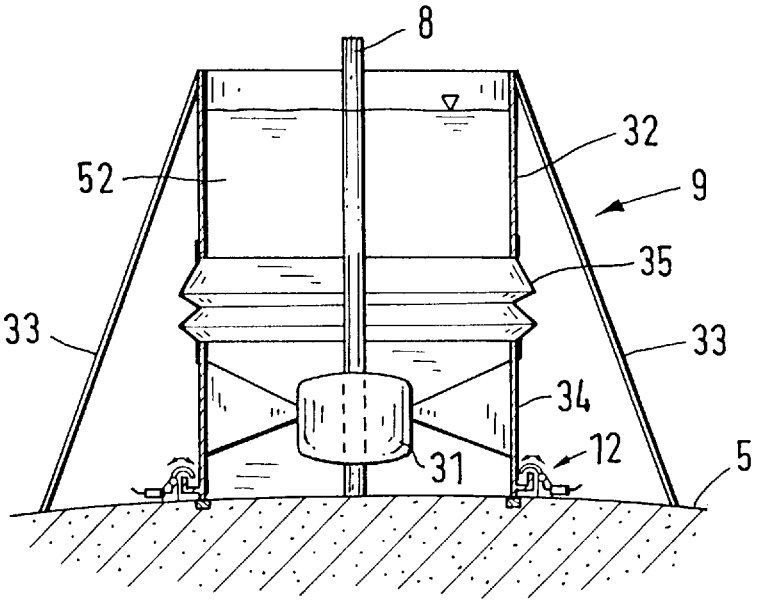
Figure 6B:
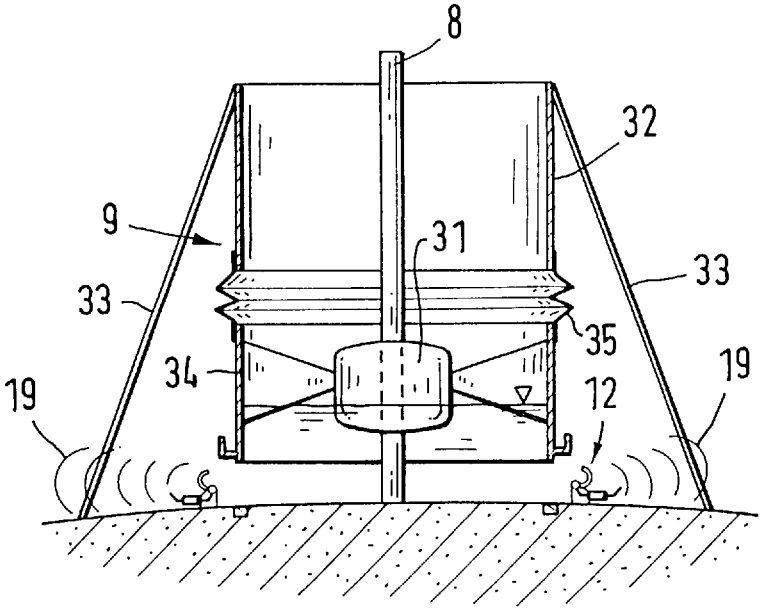

FIGS. 6*a* and 6*b* show a container variant modified with respect to the implementation form according to FIGS. 5*a* and 5*b*. Here the container 9 in of a two-piece design with an upper container section 32, which is situated stationary on the basin floor 5 by means of supports 33, an well as with a lower container section 34; a bellows 35 joins the two container sections 32 and 34 together, As was previously described for the implementation form according to FIGS. 5*a* and 5*b*, in the implementation, form according to FIGS. 6*a* and 6*b* the lower container section 34 is guided via supports 10 and the bearing bushing 11 on the pole 8 connected to the basin floor 5 so as to be raisable and lowerable, and shows the same latching mechanism. FIG. 6*a* shows the filled container 9. with an emptied fluid-storage space 1 the latching elements 12 are swung into their open position and the float 31 surrounding the bushing 11 raises the lower container section 34 until the bellows 35 is fully compressed, whereupon, in consequence of the abrupt lifting of the container section 34, the rinsing flood 19 is again discharged underneath the container 9, as illustrated in FIG. 6*b*.

Figure 7A:
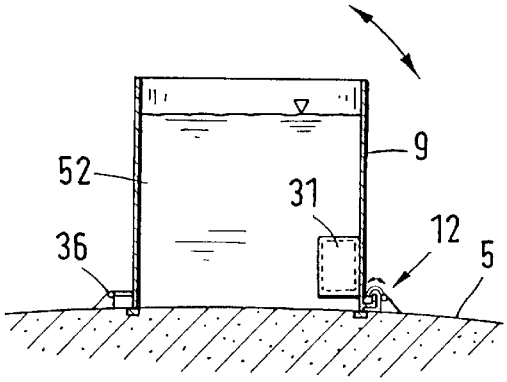
Figure 7B:
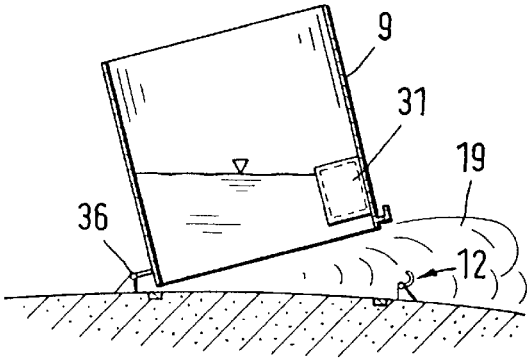

The implementation form according the FIGS. 7*a* and 7*b* illustrates a container 9 that is round or angular in cross-section and is hinged on one side and can thus be tipped. the container 9 is swingably seated on one side on a bearing 36 connected to the basin floor 5. At the opposite side are arranged one or several latching elements 12 for the latching of the container 9. The latching elements are formed in a manner corresponding to those of the implementation form according to FIGS. 6*a* and 6*b* and are correspondingly controlled. Inside, the float 31 is attached to the container 9 in the region of the latching element or elements 12 at the greatest possible distance from the bearing 36. This implementation form thus requires no poles 0 for the seating of the container 9, FIG. 7*a* shows the filled container with the latching element 12 in the latched position. FIG. 7*b* shows the opened latching element 12 and the container 9 swung around the axis of the bearing 36 by means at the float 31. as well as the rinsing flood 19 coming forth from the container 9.

Figure 8A:
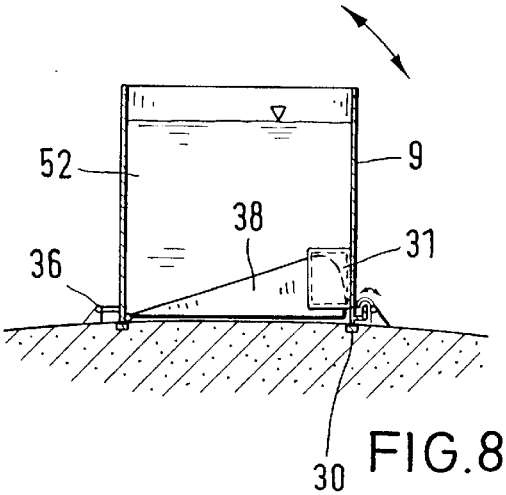
FIGS. 8*a* and 8*b* A rinsing device modified with respect to the implementation form of FIGS. 7*a* and 7*b*, in different operating states.
Figure 8B:
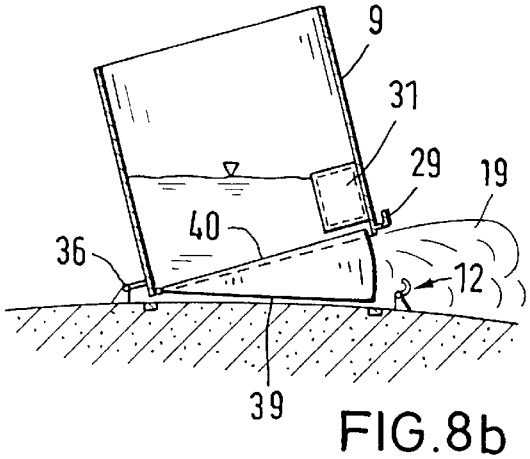

FIGS. 8*a* and 8*b* show a configuration modified with respect to the implementation form according to FIGS. 7*a* and 7*b*. The container has lateral shutters 38. FIG. 8*a* shows the filled container 9 with the lateral shutters 32. FIG. 8*b* illustrates the unlatched, upward-swung container with the corresponding shutter 38, which rest with their lower edges on the basin floor 5 and cover over the side opening of the container 9. With such a swingable arrangement of the container 9 the rinsing flood discharges in a controlled manner in one direction. in principle the possibility could exist of dispensing with one of the shutters 38.

Figure 9A:
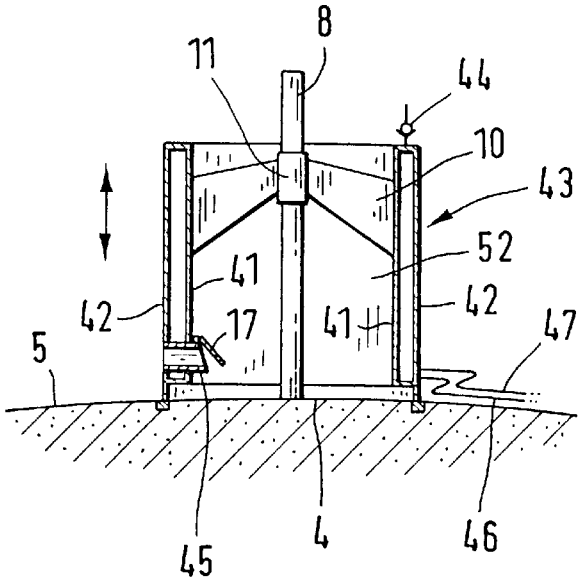
FIGS. 9*a* to 9*e* A rinsing device that is controlled by means of a ballant tank, in different views, and in different operating states.
Figure 9A:
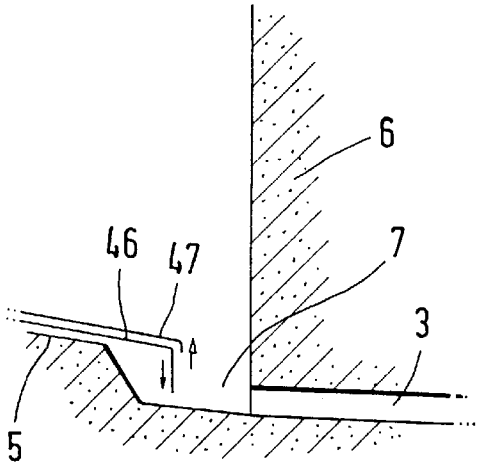
Figure 9B:
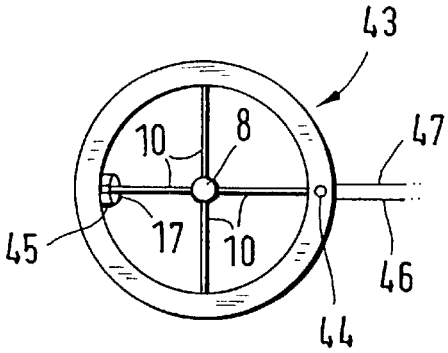
Figure 9C:
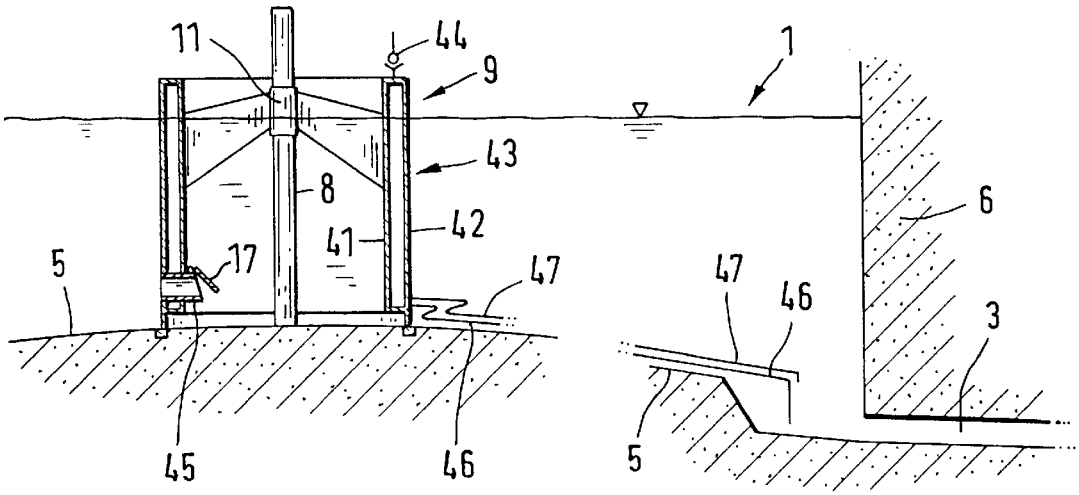
Figure 9D:
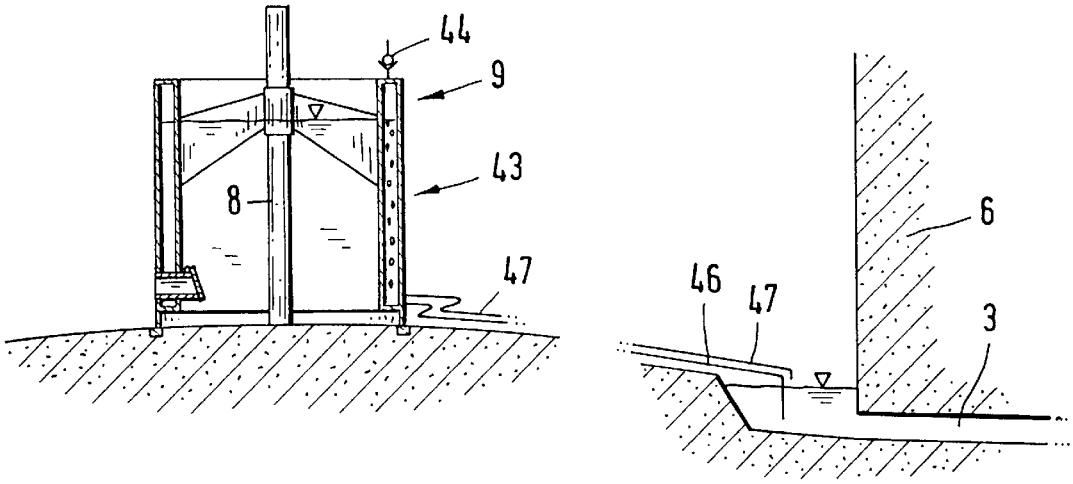
Figure 9E:
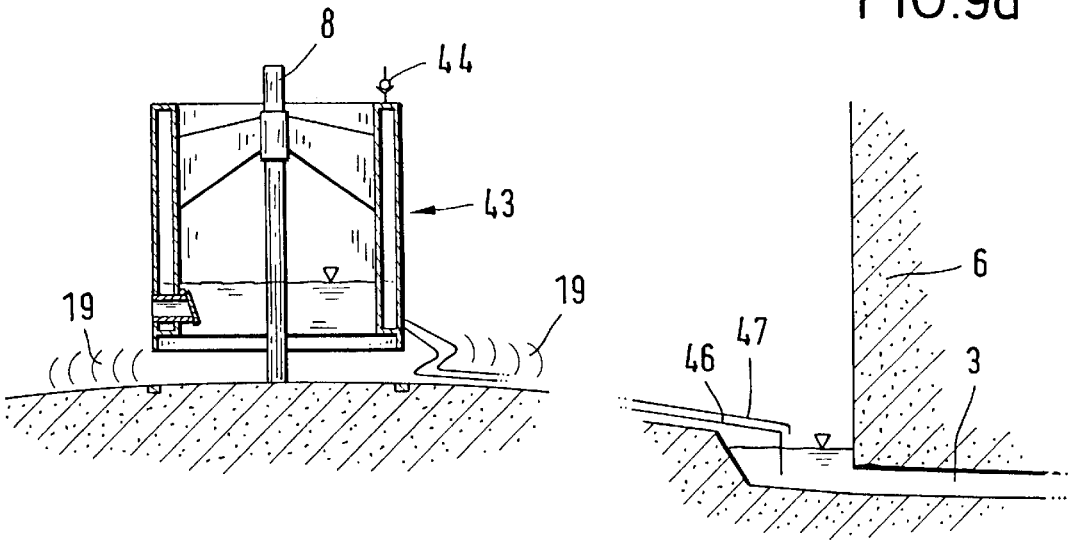

FIGS. 9*a* through 99 illustrate a variant of the container 9 guided by means of a pole 8, which variant has no float 31 and also in not controlled by means of a control float 13. and likewise required no latching elements 12. Here the container wall of the container 9 has a double-walled design, so that between the two container walls 41 and 42 a ballast tank 43 is formed. This rank is provided above with an opening, into which a check valve 44 is inverted that permits an outflow from the ballast tank 43, Lead through the ballast tank in its lower region is a connecting piece 45, whose opening, projecting into the container interior, in closable by means of a checking shutter 17. The filling of the container with storage-space fluid takes place via the connecting piece 45, just an this filling was described for the implementation form according to FIGS. 1*a* through 1*d*. From the lower end of the ballast tank a water conduit 46 and above this an air duct 47 lead to a rinsing sump with dry weather gutter 7 in the region of the outlet 3. FIG. 9*b* illustrated that with this implementation form the ballast tank 43 has a ring-shaped cross section. FIG. 9*c* shows the relationship of stored fluid in the storage-fluid space 1 to that in the container 9 when accumulation has taken place. The storage-space fluid enters into the container 9 through the connecting piece 45 and the checking shutter 17, and at the same time the storage-space fluid enters into the ballast tank 43 through the water conduit 46, the air located in the ballast tank being able to escape upward through the check valve 44. In this way the same fluid level appears in the fluid-storage space 1, in the container 9, and in the ballast tank 43 upon accumulation. If the fluid level in the fluid-storage space 1 sinks, then the rinse fluid in the container 9 and the fluid in the ballast tank 43 are held back, since neither the water conduit 46 nor the air duct 47 is it contact with air and the check valve is closed. Only when the fluid level in the fluid-storage space 1 has sunken far enough that it is below the level of the air duct 47, as it shown In FIG. 9*d*, does air reach the ballast tank 43 via the air duct 47, whereupon the fluid can flow out of the ballast tank via the water conduit 46. With this the container 9 becomes as a whole lighter and the fluid located in the container 9 can raise the container above the surface section 18 arranged in the region of the lower end of the container 9 and already described for the implementation. form according to FIGS. 2*a* and 2*b*, as shown in FIG. 9*e*. With this the rinse fluid held back in the container 9 can run out as a rinsing flood 19.

Figure 10A:
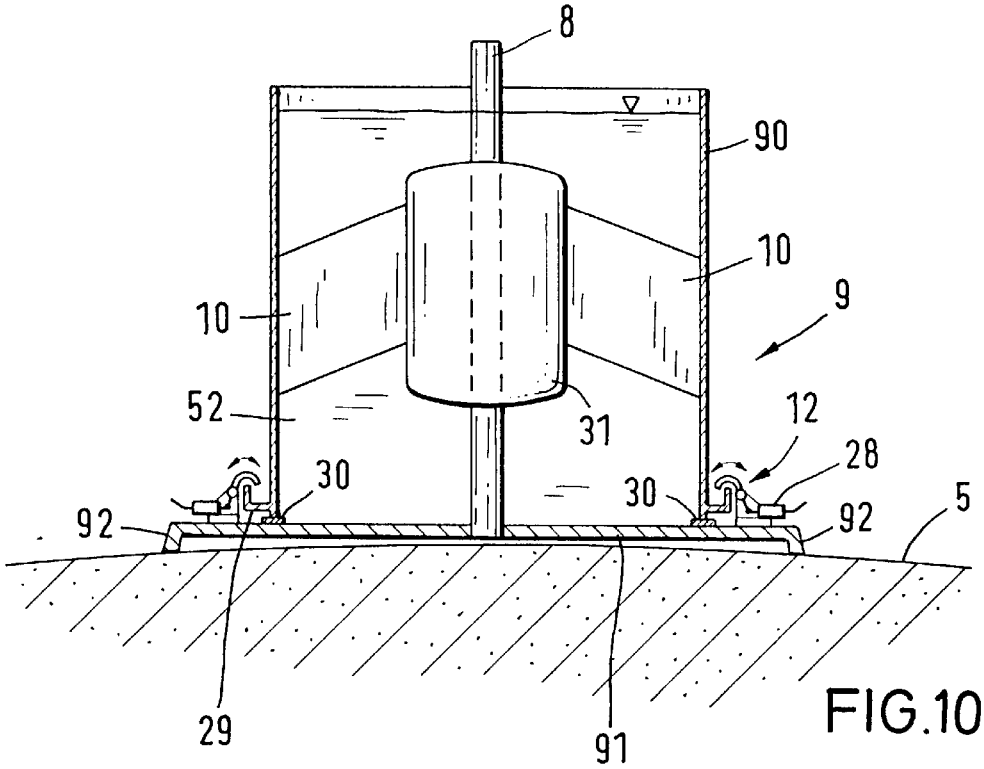
FIGS. 10*a* and 10*b* A form of the rinsing device minimally modified with respect to FIGS. 5*a* and 5*b*, in different operating states.
Figure 10B:
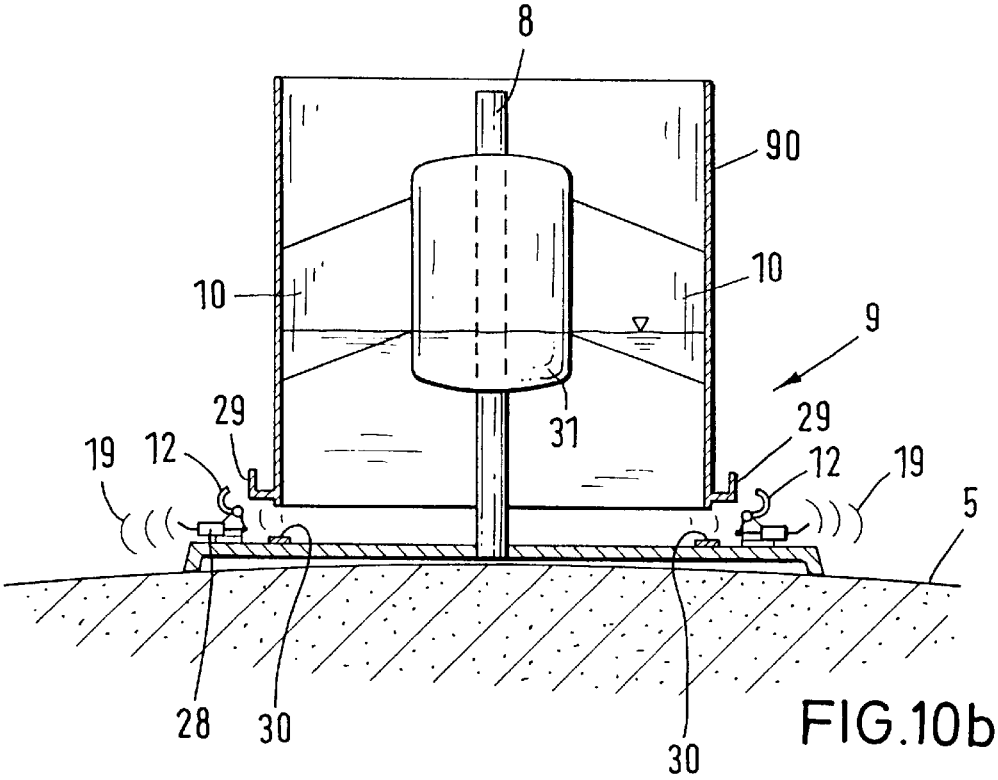

With the implementation form according to FIGS. 10*a* and 10*b* the container is formed by a cylindrical, thin-walled container wall 90 and a container bottom 91. The container bottom 91 is designed as a circular plate with a surrounding edge section 92 that rests upon the storage-space floor. Positioned centrally in the container floor 91 it the pole 8 extending perpendicular to this, on which pole is guided the sliding bearing bushing 31, which takes up the container wall 90 via the supports 10 The implementation form according to FIGS. 10*a* and 10*b* thus differs from the implementation form according to FIGS. 5*a* and 5*b* only by the fact that, instead of the sealing of the container 9 through the basin floor 5, a container bottom 91 is now arranged. With the implementation form according to FIGS. 10*a* and 10*b* the extensions 29 are accordingly attached to the container wall 90 and the latching elements 12 are situated with the hydraulic cylinders 26 on the container bottom, which also accepts the iron plate 30 that produces the sealing effect. FIG. 10*a* shows the container wall 90 in the lowered position with the container filled. FIG. 10*b* shows the container wall 90 in its position raised form the container bottom 91 in the end phase of the rinsing process.

Figure 11A:
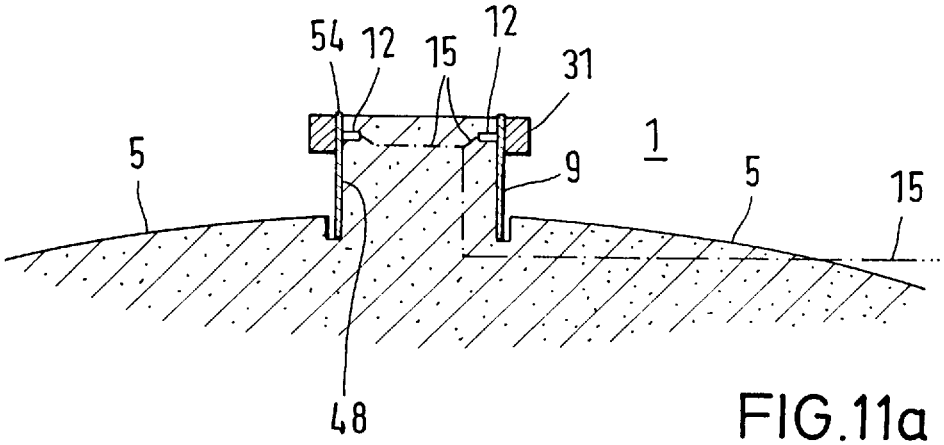
FIGS. 11*a* and 11*b* An implementation form of the rinsing device in which the container for rinsing is lowered, in different operating states.
Figure 11B:
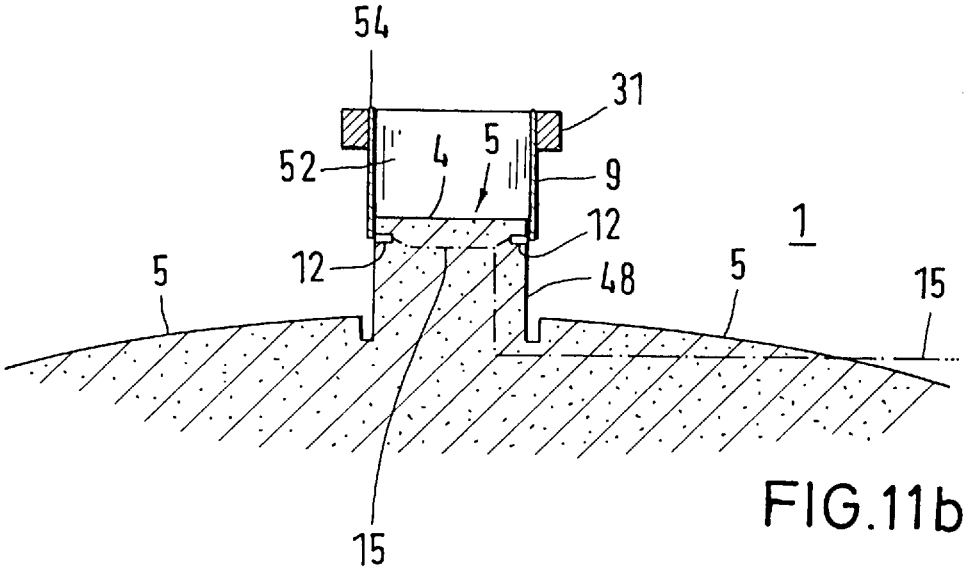

FIGS. 11*a* and 11*b* show an implementation form in which the container 9 is not raised for rinsing, but is lowered. Here the begin floor 5 shows a pedestal-like elevated point 4 that serves to support the container 9. Arranged on the pedestal 48 at its upper region are latching elements 12 that can be extended out radially towards the outside, as was described, for example, for the implementation form according to FIGS. 1*a* through 1*d*. The container 9 supports itself on these elements in their extended position. The container in surrounded in the region of its upper edge with a ring-shaped float 31. With a fluid accumulation in the fluid-storage space, the container 9. situated in FIG. 11*a* in its sunken position, is raised up, and when the container 9 reaches the raised-up position reproduced in FIG. 11*b* the latching elements 12 disengage, for examples in consequence of spring force. Stops, not shown in detail, prevent the container 9 from rising yet further upon a further accumulation of fluid in the fluid-storage space 1. The rising fluid enters the container 9 over its upper edge. If the fluid level in the fluid-storage space 1 sinks to the level of the float 13, which is illustrated in FIG. 4 by dashed lines, the latching elements 12 are then moved into their opened position shown in FIG. 11*a* and with this the rinse fluid located in the container 9 streams outward radially as a rinsing flood. During this, the lower region of the container 9 in its sunken position enters into a depression formed as a ring in the basin bottom 5. If the fluid level in the fluid-storage space 1 rises, then, at the point the the float 13 reaches the position drawn in solid lines in FIG. 4, the unlatched position of the latching elements 12 is canceled, so that these elements, under the force of the springs, press against the inner wall of the container 9 and then, when the container 9 in raised far enough, those elements rest under the container. The cross section of the container pedastal 48 is, for example, of circular form, as is that of the interior container space.

Figure 12A:
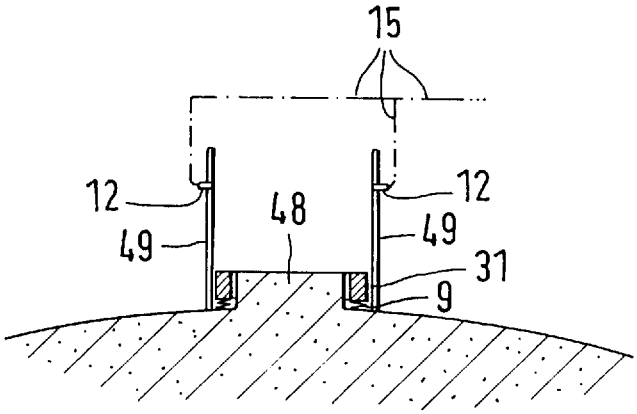
FIGS. 12*a* and 12*b* A form of the rinsing device modified with respect to FIGS. 11*a* and 11*b*, in different operating states.
Figure 12B:
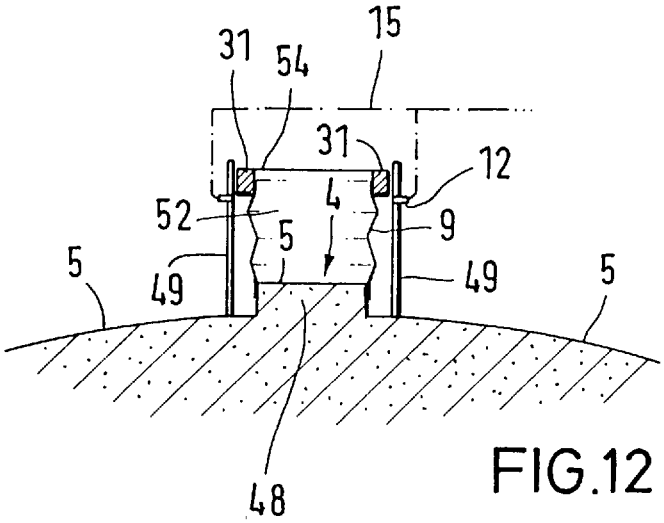

FIGS. 12*a* and 12*b* show, similarly to the representation in FIGS. 11*a* and 11*b*, a container 9 with which the rinsing fluid held inside is let out by means of a sinking of the container. Here the container 9 is designed as a bellows connected to the float 31 in the region of its upper end, the float 31 being guided vertically outside or inside by guide rods 49, in the region that does not serve for guiding, the guide rods are provided with support extensions for latching elements 12. which grasp the float 31 underneath in its raised position, in which position the bellows container 9 is extended. FIG. 12*a* shows the float 31 sunken with the bellows container 9 arranged sealed between this and the basin floor 5, which container is collapsed. In the sunken position of the container 9, the container surrounds the container pedestal 48, which by virtue of the bellows form of the container 9 has a lower height than the container pedestal 48 according to the implementation form in accordance with FIGS. 11*a* and 11*b*. With a fluid accumulation in the storage space 1 the float 31 rises and extends the bellows container 9. As soon as the float 31 reaches the level shown in FIG. 12*b*, the latching elements 12, which are controlled by the hydraulics, grasp the float 31 underneath. Since the container 9 is firmly connected to the container pedestal 48, no stop is necessary to limit the extending motion of the container 9. With an adequate fluid accumulation in the fluid-storage space, the container is flooded over and, as was described for the implementation form according to FIGS. 11*a* and 11*b*, fluid enters into the container 9. If the level in the fluid-storage space 1 sinks in the above-described sense, then the latching elements become unlatched and the float, together with the collapsing bellows container 9, falls suddenly downward, no that the rinse fluid flown out in a rinsing flood.

It is within the scope of the invention that the features described for the individual variants be combined with each other. The possibility of combination is valid in particular with respect to the hydraulic control of the container or its parts, to the damping of the movement of the container sinking towards its closing, and to the possibility that variants in which the container or parts of the container are raised up in order to discharge the rinsing flood can, instead of this, as well a be sunken in order to discharge the rinsing flood. The invention is not limited to round or curved implementations of the container or of its parts, but includes also angular configurations.

What is claimed is:

1. A device for rinsing a fluid-storage space, comprising: a rinsing chamber fillable with fluid and arranged in a region of a high point of a floor of said storage space; said rinsing chamber suddenly letting the fluid run out via a rinse opening as a rinsing flood upon an emptying of said storage space; said rinsing chamber being a container open below and raisable and lowerable as a whole or in part; said container in a lowered position being closed off by said storage space floor and in a raised position being at least partially lifted from said storage-space floor.

2. A device according to claim 1, wherein said container is open at the top.

3. A device according to claim 1, including a damping element for damping sinking movements of at least a part of said container.

4. A device according to claim 1, including means for filling said container.

5. A device according to claim 4, including an integral check flap valve in said container for self-actuated filling of said container.

6. A device according to claim 4, including a conduit for discharging into said container due to falling of storage fluid.

7. A device according to claim 4, including filling means for pumping fluid from an inlet of said storage space and into said container.

8. A device according to claim 1, including a float for raising at least a part of said container.

9. A device according to claim 1, wherein said container is seated tiltably on said storage-space floor.

10. A device according to claim 1, including at least one shutter arranged at a side of said container; said shutter covering at least one side of a container opening formed upon raising or lowering of said container.

11. A device according to claim 1, wherein at least a part of said container is rigid.

12. A device according to claim 1, wherein at least a part of said container comprises a bellows.

13. A device according to claim 1 including a ballast tank fillable with storage fluid and connected to at least a part of said container.

14. A device according to claim 1, including latching means for holding fast and latching at least a part of said container in its lowered or raised position.

15. A device according to claim 14, wherein said latching means is controlled by a level of storage-fluid.

16. A device according to claim 1, including hydraulic lifting surfaces on at least a part of said container.

17. A device according to claim 1, including means for raising and lowering at least a part of said container.

18. A device according to claim 1, including at least one guiding element connected to said storage-space floor for seating at least a part of said container.

19. A device according to claim 18, including bearing bushings connected to at least a part of said container, each bearing bushing being seated on said guiding element in a raisable and lowerable position.

20. A device according to claim 18, including cross-pieces running radially inward on at least a part of said container and connected to bearing bushings seated on a pole-shaped bearing element in a raisable and lowerable position.

21. A device according to claim 1, wherein said container is arranged in a central region of the storage space and rinses outwards.

22. A device for rinsing of a fluid-storage space, comprising: a rinsing chamber fillable with fluid and arranged in a region of a high point of a floor of said storage space; said rinsing chamber suddenly letting the fluid run out via a rinse opening as a rinsing flood upon an emptying of said storage space; said rinsing chamber being a container with a container bottom resting upon said storage space floor and with a container wall seated on said container bottom; said container wall being raisable and lowerable as a whole or in part, said container in a lowered position of said container wall being closed off by said container bottom and in a raised position of said container wall being raised up at least in part from said container bottom.

23. A device for rinsing a fluid-storage space, comprising: a rinsing chamber fillable with fluid and arranged in a region of a high point of a floor of said storage space; said rinsing chamber suddenly letting the fluid run out via a rinse opening as a rinsing flood upon an emptying of said storage space; said rinsing chamber being a container being open at top and being closed off at the bottom by said storage space floor; at least a part of said container being raisable and lowerable.

24. A rinsing container comprising: a container bottom and a container wall for accepting a fluid; said container wall having at least a part that is raisable or lowerable; said container bottom closing off at least a part of said container wall in a lowered position of said container wall, said container wall being at least partially lifted from said container bottom in a raised position of said container wall.

* * * * *